US011525376B2

(12) United States Patent
Strubbe et al.

(10) Patent No.: US 11,525,376 B2
(45) Date of Patent: Dec. 13, 2022

(54) VALVE FOR INTERNAL COMBUSTION ENGINES HAVING A COATING

(71) Applicant: FEDERAL-MOGUL VALVETRAIN GMBH, Barsinghausen (DE)

(72) Inventors: Carsten Strubbe, Gladbeck (DE); Guido Bayard, Dortmund (DE)

(73) Assignee: Federal-Mogul Valvetrain GmbH, Barsinghausen (DE)

( * ) Notice: Subject to any disclaimer, the term of this patent is extended or adjusted under 35 U.S.C. 154(b) by 984 days.

(21) Appl. No.: 16/310,609

(22) PCT Filed: Mar. 14, 2017

(86) PCT No.: PCT/EP2017/055930
§ 371 (c)(1),
(2) Date: Dec. 17, 2018

(87) PCT Pub. No.: WO2018/001578
PCT Pub. Date: Jan. 4, 2018

(65) Prior Publication Data

US 2020/0318504 A1 Oct. 8, 2020

(30) Foreign Application Priority Data

Jun. 27, 2016 (DE) ..... 10 2016 111 755.2

(51) Int. Cl.

| | |
|---|---|
| ***B05D 3/04*** | (2006.01) |
| ***F01L 3/04*** | (2006.01) |
| ***C23C 28/04*** | (2006.01) |
| ***F01L 3/14*** | (2006.01) |

(52) U.S. Cl.
CPC ..... *F01L 3/04* (2013.01); *C23C 28/046* (2013.01); *F01L 3/14* (2013.01); *F01L 2301/02* (2020.05)

(58) Field of Classification Search
CPC . F01L 3/04; F01L 3/14; F01L 2301/02; C23C 28/046
USPC ..... 427/309; 123/188.3, 193.4
See application file for complete search history.

(56) References Cited

U.S. PATENT DOCUMENTS

| | | | | |
|---|---|---|---|---|
| 8,006,715 | B2 * | 8/2011 | Shafer | F02M 61/1886 137/375 |
| 2001/0003277 | A1 * | 6/2001 | Oyama | F01L 3/10 123/90.11 |
| 2001/0006047 | A1 * | 7/2001 | Oyama | F01L 1/462 123/90.11 |
| 2001/0028049 | A1 * | 10/2001 | Mamyo | F16K 7/14 251/63.5 |
| 2004/0118455 | A1 * | 6/2004 | Welty | F16K 3/0263 137/375 |

(Continued)

FOREIGN PATENT DOCUMENTS

| | | |
|---|---|---|
| DE | 28 56 232 A1 | 7/1980 |
| DE | 196 47 099 A1 | 5/1998 |

(Continued)

*Primary Examiner* — Hung Q Nguyen
*Assistant Examiner* — Anthony Donald Taylor, Jr.
(74) *Attorney, Agent, or Firm* — Robert L. Stearns; Dickinson Wright, PLLC

(57) ABSTRACT

The present invention for coating a valve head (6) of an inlet and/or outlet valve (4) comprises a preparation of a surface, which is to be coated, of the valve (4) for a coating, and a coating of the prepared surface with a ceramic high-temperature coating (22).

13 Claims, 3 Drawing Sheets

(56) References Cited

U.S. PATENT DOCUMENTS

| | | | | |
|---|---|---|---|---|
| 2009/0255506 | A1* | 10/2009 | Walker | F02C 6/206<br>123/212 |
| 2010/0275875 | A1* | 11/2010 | Doi | C23C 28/36<br>123/197.3 |
| 2014/0366818 | A1* | 12/2014 | Lawes | F01L 7/18<br>123/59.1 |

FOREIGN PATENT DOCUMENTS

| | | | | |
|---|---|---|---|---|
| DE | 19647099 | A1 * | 5/1998 | C23D 5/02 |
| DE | 10 2010 052971 | A1 | 5/2012 | |
| EP | 1 614 946 | A1 | 1/2006 | |

* cited by examiner

32

2
8
8
12
20
16
18
10
14
18
6
12
22
14

4
8
32
4
34
22/6

22/18
22/16
18
20
10

32

4
8
12
16
18
30/20
14
22
30
22
20
18
12
22
10

4
4

18
22
16

VALVE FOR INTERNAL COMBUSTION ENGINES HAVING A COATING

BACKGROUND

1. Technical Field

The present invention relates to cooled valves for internal combustion engines. More specifically, the present invention relates to a sodium cooled inlet or outlet valve for an internal combustion engine, which is provided with an outer coating, to reduce or to influence, respectively, a heat transfer to the valve. The outer coating can further contribute to reducing a corrosion and a deposit of combustion residues on the valve or the valve head, respectively.

2. Related Art

Internally cooled or sodium cooled exhaust gas valves have been known since at least 1935.

Sodium cooling and the effects thereof are well known in the prior art and the technical further developments of the last years related predominantly to an increased coolant volume in the area of the valve plate and simplified production methods in order to be able to produce sodium cooled valves more cost-efficiently.

However, there is still a need to further improve the cooling or the cooling properties, respectively, in particular of exhaust gas valves. There is also a need to have a valve, which is protected against corrosion. It is furthermore desirable to reduce the amount of deposits, which can deposit on a valve.

SUMMARY

According to the present invention, a method for coating a valve head of an inlet and/or outlet valve comprising the features of the independent claim, and a valve produced by means of the method is provided, wherein preferred embodiments of the method are described in the dependent claims.

A method for coating a valve head of an inlet and/or outlet valve is provided according to the present invention. The method thereby comprises a preparation of the surfaces, which are to be coated, of the valve for a coating, and a coating of the valve head with a ceramic high-temperature coating. The ceramic high-temperature coating is thereby applied as varnish to the prepared locations of the valve at least in the head area and is cured. The ceramic high-temperature coating is not a vapor coating, a nitration or a plasma deposition method. The ceramic high-temperature coating is thereby applied to the valve head or to parts of the valve head as varnish by spraying, by brushing on or by dipping or also by overflowing. It is likewise provided to use a so-called "spin coating" in order to apply the ceramic high-temperature coating to the valve head or to parts of the valve head. After the application, the coating is cured in the head area.

In the case of an exemplary embodiment of the method, the preparation of the surfaces, which are to be coated, of the valve comprises a sand/shot blasting, a cleaning and/or a slight etching or etching respectively, of the surfaces, which are to be coated. It can be ensured with these methods that the adhesion between the ceramic high-temperature coating and the metal surface of the valve is sufficiently high for the load, in order to avoid a detaching of the varnish.

In the case of a further embodiment of the present method, the ceramic high-temperature coating has a temperature stability of between 950° C. and 1100° C., preferably between 970° C. and 1050° C., and more preferably between 990° C. and 1020° C. The coating thereby needs to be able to withstand the temperatures of the combustion gases, whereby it needs to be considered that the valve itself is cooled, and the high-temperature load is absorbed on the one side of the coating and by the cooled valve on the other side. The high-temperature coating is also cooled by the cooled valve and can thus also withstand exhaust gas temperatures, which lie above the stability temperatures of the coating. This makes it possible to also use the high-temperature coating in the case of exhaust gas temperatures above the temperature stability of the coating, because the cooled valve surface keeps the temperature of the coating below the stability temperature.

According to a further alternative of the method, the ceramic high-temperature coating is an air-drying ceramic high-temperature coating. The method thereby comprises the step of air drying of the ceramic high-temperature coating.

According to another further alternative of the method, the ceramic high-temperature coating is an oven-drying ceramic high-temperature coating. The method thereby comprises the step of the oven drying of the ceramic high-temperature coating.

In a further additional exemplary embodiment of the method, the cured ceramic high-temperature coating has a thickness of between 10 μm and 50 μm, preferably of between 15 μm and 40 μm, and more preferably of between 20 μm and 30 μm. The method thereby comprises the application of a varnish layer comprising a thickness, which, after the curing, results in the above-mentioned thicknesses of the cured varnish layer.

In the case of a further embodiment of the present invention, the ceramic high-temperature coating is embodied as a multi-layer coating, which comprises at least one primer and at least one top coat. The method thus comprises the steps of applying a ceramic high-temperature coating at least twice, first as applying of a primer and a curing of the primer, and a subsequent applying of a ceramic high-temperature coating as top coat.

In the case of a further exemplary embodiment of the method, the ceramic high-temperature coating is embodied as a multi-layer coating, which comprise at least one primer and at least one top coat. The method thereby comprises at least one coating of the valve head with a primer, and a subsequent coating of the primer with at least one top coat. It can also be provided to process the primer, which has already been applied, prior to applying the top coat, in order to attain a desired thickness of the primer or a desired surface roughness of a surface of the primer. It can also be provided that the top coat is applied, before the primer has cured completely by drying or oven-drying.

In the case of a further embodiment of the method, at least one valve seat of the valve is provided with a DLC coating. The valve seat is the part of the valve head, which abuts on the valve seat ring in the cylinder head when the valve is closed, and thus seals the combustion chamber against an inlet channel or an outlet channel in the cylinder head. The term "valve seat" is only used here in combination with an essentially conical surface on the valve plate or valve head, respectively, the expression "valve seat ring" is used when reference is made to the corresponding surface on the cylinder head.

In the case of another exemplary embodiment of the method, the latter further comprises a coating of a valve head of the valve with the ceramic high-temperature coating with the exception of the valve seat. The valve seat of the valve head can have been coated with a DLC layer beforehand, whereby it is also possible to apply it later to an uncoated part of a DLC layer. It can also be provided to completely coat the valve head with the ceramic high-temperature coating and to then remove it again in the area of the valve seat. In the case of this embodiment, it is also possible to apply a DLC layer in the area of the valve seat beforehand.

The ceramic high-temperature coating can serve as insulating layer, which reduces a heat transfer from the combustion chamber via the plate surface and, in the case of an outlet valve, additionally of combustion gases via the valve head to the valve. The cooling power of the valve via the valve shaft onto the cooled cylinder head is not influenced by the ceramic high-temperature coating, because the valve shaft is not coated with the ceramic high-temperature coating. By means of a smaller heat input and an unchanged heat output, the overall temperature of the valve can be lowered during operation. In the case of suction valves, it will be sufficient to only coat the surface of the valve plate on the combustion chamber side, because the drawn-in air or the drawn-in mixture, respectively, has a low temperature, and the rear side of the valve can thus be used to cool the valve head. A coating of the valve head on the side facing away from the combustion chamber would only lead to an increase of the valve temperature here.

According to a further embodiment of the present invention, the ceramic high-temperature coating is only applied to the underside of a valve plate in the case of the method. This method is in particular suitable for suction valves or inlet valves, respectively, of a motor. In the case of a further embodiment, only the valve head, but not the underside of a valve plate, is coated with the ceramic high-temperature coating. The exhaust gas channel can have a higher temperature than the combustion chamber, because it is cooled by means of the fresh air, which flows in or by means of the mixture, which flows in, respectively, at least in response to the intake stroke.

In the case of a further embodiment of the method, the ceramic high-temperature coating is also applied to the valve shaft or only to the valve shaft.

According to a further aspect of the present invention, an inlet or outlet valve is provided, which was produced according to one of the above-described methods, wherein a valve head of the valve is coated with a ceramic high-temperature coating. The ceramic high-temperature coating is thereby applied to a prepared surface on the valve head, which has a certain roughness. The surface, which is coated with the ceramic high-temperature coating, was thereby pre-treated by means of sand/shot blasting, a cleaning and/or a slight etching or etching, respectively, of the surfaces, which are to be coated, and thus has a particularly good adhesion of the ceramic high-temperature coating on the valve head. At least a part of the valve head is thereby coated.

The ceramic high-temperature coating of the valve can thereby have a temperature stability of between 950° and 1100° C., preferably between 970° C. and 1050° C., and more preferably between 990° C. and 1020° C.

In the case of an embodiment of the valve, the ceramic high-temperature coating is an air-dried ceramic high-temperature coating. This allows for a simple drying without additional energy consumption.

In the case of another embodiment of the valve, the ceramic high-temperature coating is an oven-dried ceramic high-temperature coating. An oven-dried ceramic high-temperature coating can have a higher stability, because the drying process can be controlled better.

In the case of an additional exemplary embodiment of the valve, the ceramic high-temperature coating has a thickness of between 10 μm and 50 μm, preferably of between 15 μm and 40 μm, and more preferably of between 20 μm and 30 μm. The ceramic high-temperature coating, which is kept relatively thin, is to represent an insulating layer on the one hand, in order to reduce the heat transfer on the metal body of the valve, but the insulating effect is to not be so pronounced that a surface temperature of the ceramic high-temperature coating can exceed a stability temperature during operation, at which the ceramic high-temperature coating is destroyed. Only the thermal resistance is to be increased, but not to the extent that the surface of the ceramic high-temperature coating can be destroyed by means of an excessive heating by the combustion gases.

In the case of another exemplary embodiment of the valve, the ceramic high-temperature coating is embodied as a multi-layer coating, which comprises at least one primer and at least one top coat. A multi-layer coating can make it possible to better control the overall properties of the coating. The primer can serve as adhesion promoter. The primer can also have a slightly lower stability temperature, because it is protected by the ceramic high-temperature coating located thereabove and is applied to a cooled valve surface.

In the case of a further exemplary embodiment of the valve, the latter further comprises at least one valve seat, which is coated with a DLC (diamond like carbon) layer. The DLC layer is preferably not coated with the ceramic high-temperature coating.

In the case of a further embodiment of the present invention, the valve is not coated with the ceramic high-temperature coating in the area of the valve seat and can also be armored, provided with another coating or with a nitration in the area of the valve seat.

In the case of another exemplary embodiment of the valve, the entire valve head was coated with the ceramic high-temperature coating, wherein the valve head was provided with a DLC layer in the area of the valve seat, and the ceramic high-temperature coating was removed in a subsequent operating step in the area of the valve seat.

The coating is a protective coating as well as a thermal insulation, which is to reduce the heat input into the valve. Due to the reduced heat input at cooling conditions, which remain the same over the valve shaft, the overall temperature of the valve can be lowered as compared to an uncoated valve.

In the case of an embodiment of the valve, the ceramic high-temperature coating is applied only to the underside of a valve plate.

In the case of a further embodiment of the valve, the ceramic high-temperature coating is only applied to the rear side of the valve plate.

In the case of an additional embodiment of the valve, the ceramic high-temperature coating is applied to the valve shaft or only to the valve shaft.

THE DRAWINGS

The present invention will be clarified in more detail below by means of illustrations of exemplary embodiments. The figures only represent schematic illustrations.

Figures 1, 2, 3:
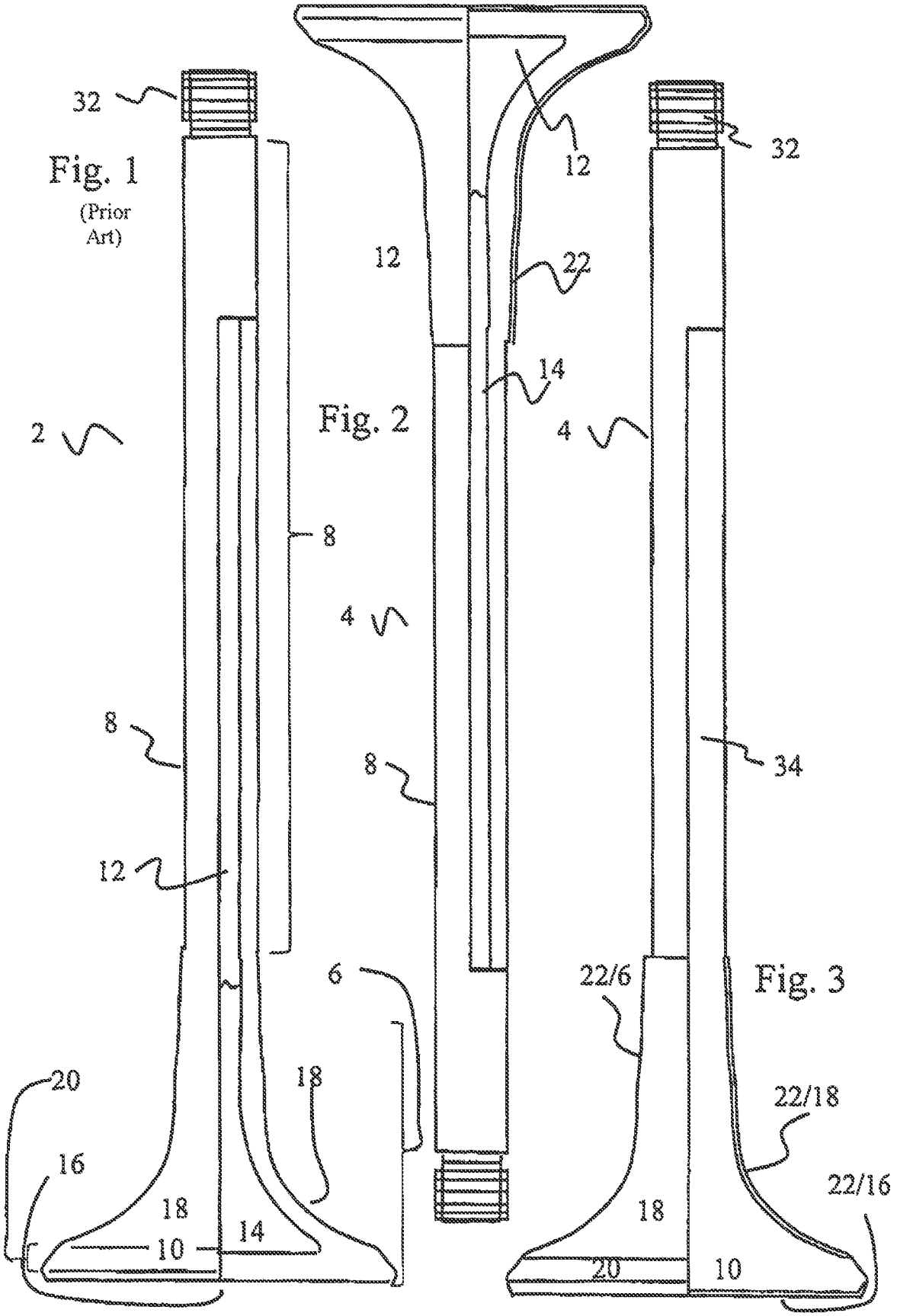
Fig. 1 (Prior Art)
FIG. 1 shows a partial sectional view of a standard internally cooled valve.
FIG. 2 shows a partial sectional view of an internally cooled valve according to the invention comprising a ceramic high-temperature coating, which is arranged on the entire valve head.
FIG. 3 is a partially cut illustration of a valve according to the invention comprising a ceramic high-temperature coating, which is arranged on the valve plate surface and on a valve plate rear side.

Identical or similar reference numerals are used in the description as well as in the figures, in order to make reference to identical or similar components and elements. To avoid unnecessary lengths in the description, elements, which have already been described in a figure, are not mentioned separately in further figures.

FIG. 1 shows a partial sectional view of a standard internally cooled valve 2. A standard internally cooled valve 2 comprises a valve shaft 8 and a valve head 6. The valve head 8 thereby extends essentially to the valve shaft 8, wherein a section of the length of a valve stroke can be provided between the valve shaft 8 and the valve head. The valve head 6 has a tapered part and the valve plate 10. The valve plate 10 comprises the valve plate surface 16, which is directed to a combustion chamber, the frustoconical valve seat 20, and the valve plate rear side 18, which is arranged in a suction channel or an exhaust gas channel, respectively. The standard internally cooled valve 2 has no coatings whatsoever on the inside, the standard internally cooled valve 2 is provided with a hollow space, in which a coolant 14, mostly sodium, is arranged. The sodium transports heat from the valve head 6 to the valve shaft 8, which is embedded in a cooled cylinder head. The heat of the sodium is output to the cooled cylinder head via the valve shaft 8. Due to the fact that the sodium or the coolant, respectively, moves up and down, this is referred to as a "shaker-cooling". The valve shaft 8 ends in a valve shaft end 32, on which the valve is held via wedge pieces.

High-temperature loaded valve parts, in particular the valve plate surface 16 and the valve plate rear side 18, are made of austenitic materials or of nickel-based materials. Until now, it was customary to protect the shafts of highly-loaded valves by nitration or hard chromium plating. It now appears likely, however, that hard chromium plating cannot be used any longer, because chromium (VI), which is created in response to the hard chromium plating for process-related reasons, is a biohazard.

FIG. 2 shows a partial sectional view of an internally cooled valve 4 according to the invention comprising a ceramic high-temperature coating 22, which is arranged on the entire valve head 6. In contrast to the valve of FIG. 1, the valve head 6 is in particular coated with a ceramic high-temperature coating 22 on the valve plate surface 16, the valve seat 20, as well as the valve plate rear side 18. The ceramic high-temperature coating 22 attains an improvement of the temperature and corrosion resistance of the valves on the valve plate surface 16 as well as of the valve plate rear side 18 in the so-called groove area. The coating can improve the tribological properties (friction and wear) as well as the corrosion protection in the shaft area of valves. The use of the ceramic high-temperature coating 22 can serve as an alternative for the hard chromium plating of valves in the shaft area.

The ceramic high-temperature coating 22 can be a Cerakote Ceramic coating by PBN (Pulverbeschichtung Nord GmbH), which provides for a temperature stability of 650° C., up to 1,100° C. Cerakote Ceramic Coatings are temperature-stable to above 1,100° C. and are characterized by a hard and abrasion-resistant surface. These coatings provide for a temperature stability to above 1,100° C., an excellent corrosion protection, as well as an ideal thermal insulation. This coating can also be used on the valve head 6 as well as on the valve shaft 8.

As liquid coating material, ceramic-based high-temperature varnishes as liquid coating material can create a thermal barrier layer or insulation, respectively, and a corrosion protection in a simple manner. After a pre-treatment of the valves to be coated, the varnish can be applied by means of blasting, cleaning or etching, for example by means of a paint spraying gun. It is also possible to dip the valves into a varnish. The layer thickness is to be between 10 and 50 μm. The varnish can be dried or baked, respectively, in an oven at temperatures of below 200° C. or can air-dry in up to 5 days. It can be made possible by means of the coating to use cost-efficient materials, instead of expensive substrate materials (e.g. nickel-based) for the valve body.

The ceramic high-temperature coating 22 has a very high abrasion resistance, wherein detaching particles have a size in the micrometer range, so that no damages whatsoever to turbochargers have to be expected due to detached particles. The ceramic high-temperature coating 22 has a very high hardness and thus a very high scratch resistance. The ceramic high-temperature coating 22 is resistant to chemicals and can attain a very high surface quality. Complex coating systems are not required for applying the coating.

FIG. 3 is a partially sectional illustration of a valve 4 according to the invention comprising a ceramic high-temperature coating 22, which is arranged on the valve plate surface 16 and a valve plate rear side 18. FIG. 3 shows a valve 4, in the case of which the shaft is embodied as full shaft 34. In the case of all embodiments, it is also possible to use valves comprising a full shaft 34 instead of internally cooled valves, wherein the full shaft has only been chosen here, in order to more clearly emphasize the coating. In the case of FIG. 3, the ceramic high-temperature coating 22 is applied to the valve plate surface 16 as well as to the valve plate rear side 18. The area of the valve seat 20 was not coated, because the stability of the ceramic high-temperature coating 22 may not be able to withstand in particular the strong alternate load on the valve seat 20. The valve seat 20 can be embodied to be armored as in the case of standard valves.

Figures 4, 5, 6:
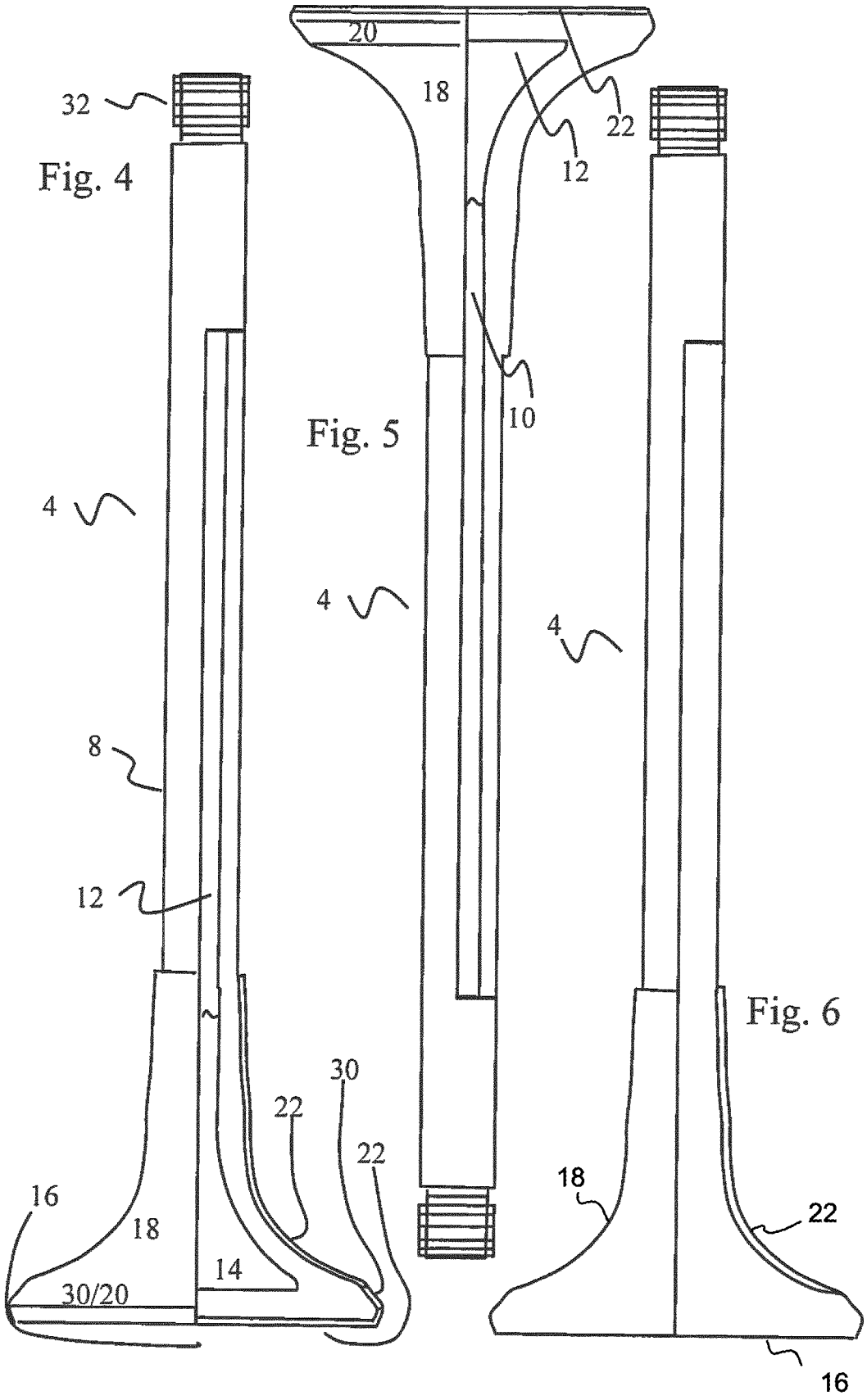
FIG. 4 shows a partial sectional view of an internally cooled valve, wherein a valve seat comprising a DLC layer is provided, and a ceramic high-temperature coating is further arranged on the valve plate surface and on the valve plate rear side.
FIG. 5 shows a partial sectional view of an internally cooled valve, wherein a ceramic high-temperature coating is applied to the valve plate surface.
FIG. 6 shows a partial sectional view of an internally cooled valve, wherein a ceramic high-temperature coating is applied to the valve plate rear side.

FIG. 4 shows a partial sectional view of an internally cooled valve 4, wherein the valve seat 20 is provided with a DLC layer 30, and a ceramic high-temperature coating 22 is further arranged on the valve plate surface and the valve plate rear side. DLC stands for Diamond Like Carbon, a coating comprising some properties of diamond. Only the valve seat 20 is provided with the DLC layer here. This embodiment can withstand the higher loads, in particular the loads of the valve seat, longer.

FIG. 5 shows a partial sectional view of an internally cooled valve 4, wherein a ceramic high-temperature coating 22 is applied only to the valve plate surface 16. Such a valve is suitable in particular for inlet valves, because the thermal load on the valve plate rear side 18 is much smaller than in the case of the exhaust gas or outlet valves, respectively.

FIG. 6 shows a partial sectional view of an internally cooled valve 4, wherein a ceramic high-temperature coating 22 is applied to the valve plate rear side 18. It is assumed here that the thermal load of the valve plate rear side 18 is higher than that of the valve plate surface 16, because the valve plate surface 16 is cooled by means of a mixture, which flows in, at least in response to the intake stroke, while the exhaust gas channel is always only in contact with the hot combustion gases.

Figure 7:
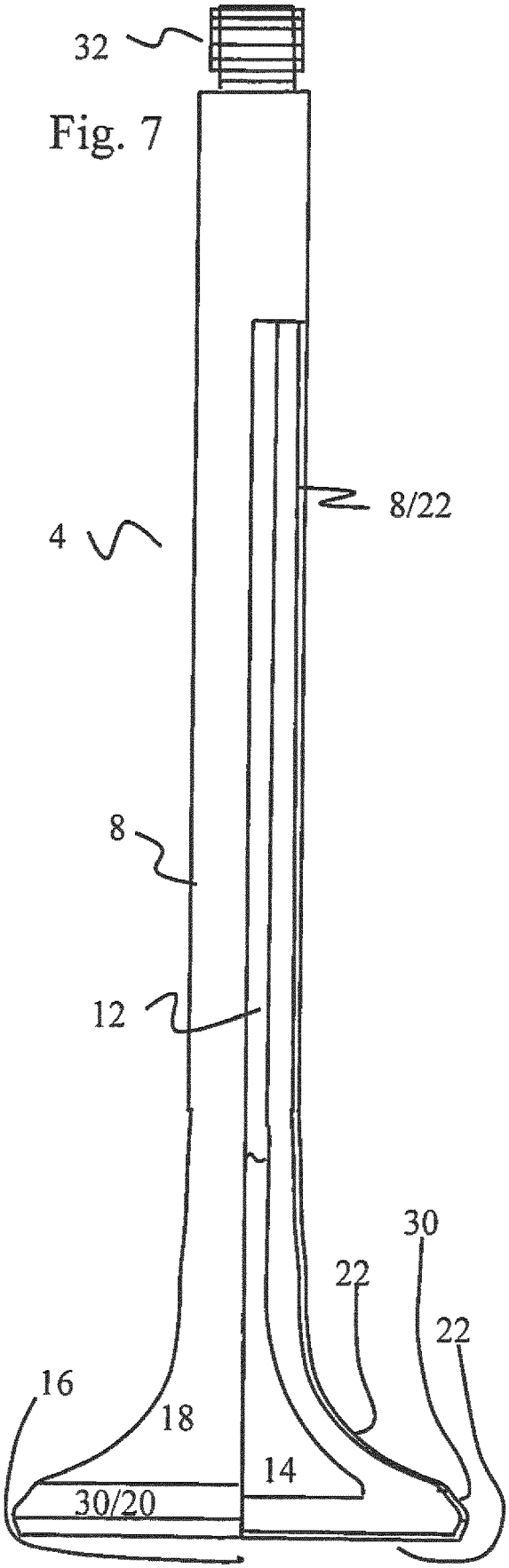
FIG. 7 shows a partial sectional view of an internally cooled valve, wherein a ceramic high-temperature coating is also applied to the valve shaft.

FIG. 7 shows a partial sectional view of the internally cooled valve 4 of FIG. 4, wherein a ceramic high-temperature coating 22 is also applied to the valve shaft. It is also possible to provide only the valve shaft 8 with the ceramic high-temperature coating 22. In this case, the ceramic high-temperature coating 22 serves predominantly to reduce the abrasion with regard to the valve guides, which is possible in particular in the case of low-power motors. The disadvantage of the insulating effect of the ceramic high-temperature coating 22 on the shaft, however, is not so special, because the small diameter of the valve shaft 8 as compared to the relatively small volume to be cooled results in an excellent ratio of surface to volume, which, as a whole, implies only a small deterioration of the cooling in spite of an insulating layer.

It is provided to also consider combinations of individual coating types as being disclosed, in particular all combinations of the coatings of FIGS. 5, 6 and 7, as well as all possible combinations of the coatings of FIGS. 5, 6 and 7 with the DLC layer on the valve seat according to FIG. 4. These embodiments were only omitted so as not to overload the description by means of redundant combinations of individual coating types. It is also important to mention that other coating materials or different ceramic high-temperature coatings, respectively, can in each case be used for the partial coatings of FIGS. 5, 6 and 7.

The invention claimed is:

1. A method of coating a valve head of an inlet or outlet valve, comprising:

coating a seat portion of the valve head with a DLC coating to provide a DLC-coated seat portion of the valve head;

thereafter coating the DLC-coated seat portion of the valve head and an adjacent surface of the valve head with a ceramic high-temperature coating by means of varnishing;

thereafter removing the ceramic high-temperature coating from the DLC-coated seat portion of the valve head to expose the DLC-coated seat portion of the valve head; and thereafter curing the ceramic high-temperature coating on the adjacent surface of the valve head.

2. The method according to claim 1, wherein the seat portion of the valve head and the adjacent surface of the valve head are prepared prior to being coated by at least one of sand/shot blasting, cleaning, and etching.

3. The method according to claim 1, wherein the ceramic high-temperature coating has a high-temperature stability of between 950° C. and 1100° C.

4. The method according to claim 1, wherein the ceramic high-temperature coating is an air-drying ceramic high-temperature coating.

5. The method according to claim 1, wherein the ceramic high-temperature coating is an oven-drying ceramic high-temperature coating.

6. The method according to claim 1, wherein the cured ceramic high-temperature coating has a thickness of between 10 μm and 50 μm.

7. The method according to claim 1, wherein the ceramic high-temperature coating is embodied as a multi-layer coating, which comprises at least one primer and at least one top coat.

8. The method according to claim 1, wherein the ceramic-high temperature coating is also applied to a valve shaft of the inlet or outlet valve.

9. An inlet or outlet valve, produced according to the method of claim 1.

10. The method according to claim 1, wherein the ceramic high-temperature coating has a high-temperature stability of between 970° C. and 1050° C.

11. The method according to claim 1, wherein the ceramic high-temperature coating has a high-temperature stability of between 990° C. and 1020° C.

12. The method according to claim 1, wherein the cured ceramic high-temperature coating has a thickness of between 15 μm and 40 μm.

13. The method according to claim 1, wherein the cured ceramic high-temperature coating has a thickness of between 20 μm and 30 μm.

* * * * *